US009597783B2

(12) United States Patent
Zhang

(10) Patent No.: US 9,597,783 B2
(45) Date of Patent: Mar. 21, 2017

(54) BIT ASSEMBLY

(71) Applicant: CHERVON INTELLECTUAL PROPERTY LIMITED, Road Town (VG)

(72) Inventor: Xiaofeng Zhang, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 317 days.

(21) Appl. No.: 14/320,815

(22) Filed: Jul. 1, 2014

(65) Prior Publication Data

US 2015/0013508 A1 Jan. 15, 2015

(30) Foreign Application Priority Data

Jul. 2, 2013 (CN) ..... 2013 1 0275271
Jul. 2, 2013 (CN) ..... 2013 2 0390803

(51) Int. Cl.

*B25B 15/00* (2006.01)
*B25B 19/00* (2006.01)
*B25B 21/02* (2006.01)
*B25B 23/12* (2006.01)

(52) U.S. Cl.

CPC ..... *B25B 15/001* (2013.01); *B25B 21/02* (2013.01); *B25B 23/12* (2013.01)

(58) Field of Classification Search

CPC ..... B25B 15/001; B25B 23/12; B25B 21/02; B25B 23/0035; B25B 19/00

See application file for complete search history.

(56) References Cited

U.S. PATENT DOCUMENTS 2,218,631 A * 10/1940 West et al. ..... B25B 15/02 403/149
3,253,626 A * 5/1966 Stillwagon, Jr. et al. ..... B25B 23/12 29/DIG. 27
3,312,260 A * 4/1967 MacNeill ..... B25B 23/0035 81/124.6
3,347,293 A * 10/1967 Clark ..... B25B 15/00 279/79
4,096,896 A * 6/1978 Engel ..... B25B 23/0035 81/121.1
4,535,658 A * 8/1985 Molinari ..... B25B 23/0035 81/177.85
4,818,157 A * 4/1989 Kouvelis ..... B23B 31/005 279/145
5,343,786 A * 9/1994 Wridt ..... B25B 15/001 279/9.1
5,604,948 A * 2/1997 McMahon ..... B25B 19/00 29/566.4
5,848,832 A * 12/1998 Hsieh ..... B25B 13/461 362/119

(Continued)

*Primary Examiner* — David B Thomas
(74) *Attorney, Agent, or Firm* — Greenberg Traurig, LLP

(57) ABSTRACT

A bit assembly includes a bit for driving a screw, a shank for holding and driving the bit to rotate about a pivot axis wherein the bit is capable of moving relative to the shank in a predetermined range, and a limiting structure formed between the bit and the shank for preventing the bit to move beyond the predetermined range. The bit and the shank are made of different materials and form a sliding connection so that they have a certain buffer space in the axial direction and in the circumferential direction thereby reducing the effect of impacts on the service life of the bit assembly.

20 Claims, 9 Drawing Sheets

(56) References Cited

U.S. PATENT DOCUMENTS 5,868,047 A * 2/1999 Faust ..... B23P 15/00 81/438
5,960,681 A * 10/1999 Anderson ..... B21K 5/16 81/121.1
5,975,815 A * 11/1999 Zierpka ..... B25B 21/007 279/22
6,209,426 B1 * 4/2001 Takahashi ..... B25B 23/12 81/451
6,530,299 B1 * 3/2003 Liu ..... B25B 23/12 81/125
6,698,319 B2 * 3/2004 Huang ..... B25B 23/12 81/438
6,931,967 B1 * 8/2005 Chang ..... B25B 15/001 81/125
7,096,768 B1 * 8/2006 Chen ..... B25B 23/12 81/125
7,107,882 B1 * 9/2006 Chang ..... B25B 23/12 81/125
7,261,023 B2 * 8/2007 Taguchi ..... B25B 15/001 81/438
7,565,854 B2 * 7/2009 Chiang ..... B25B 15/001 279/75
7,574,946 B1 * 8/2009 Chang ..... B25B 23/12 81/177.85
D624,383 S * 9/2010 Hsu ..... D8/86
D627,205 S * 11/2010 Hsu ..... D8/86
7,823,890 B2 * 11/2010 Chen ..... B25B 15/001 279/128
D631,723 S * 2/2011 DeBaker ..... D8/86
7,891,275 B2 * 2/2011 Huang ..... B25B 23/0035 279/75
7,896,357 B2 * 3/2011 Peters ..... B23B 31/005 279/143
7,922,180 B2 * 4/2011 Meng ..... B25B 15/001 279/143
D663,187 S * 7/2012 Debaker ..... D8/86
8,418,587 B2 * 4/2013 DeBaker ..... B25B 15/002 81/436
8,465,169 B2 * 6/2013 Lin ..... B25B 13/463 362/109
8,468,913 B1 * 6/2013 Bond ..... B25B 23/12 81/438
8,479,616 B2 * 7/2013 Tsai ..... B25B 13/06 279/128
8,690,164 B2 * 4/2014 Meng ..... B25B 23/0035 279/155
8,695,461 B2 * 4/2014 Moss ..... B25B 13/06 81/125
D706,106 S * 6/2014 Chen ..... D8/86
8,800,407 B2 * 8/2014 DeBaker ..... B25B 15/002 76/101.1
8,864,143 B2 * 10/2014 Lin ..... B25B 23/0035 279/128
8,943,931 B2 * 2/2015 Chiang ..... B25B 15/001 279/75
8,973,474 B2 * 3/2015 Lai ..... B25B 15/002 81/184
9,114,522 B1 * 8/2015 Bond ..... B25F 1/02 81/439
9,211,620 B2 * 12/2015 Nagy ..... B23Q 3/15506 483/16
9,227,309 B2 * 1/2016 Moss ..... B25B 23/0035 279/102
9,375,829 B2 * 6/2016 Su ..... B25B 23/0035 81/438
2004/0093997 A1 * 5/2004 Huang ..... B25B 15/001 81/125
2005/0098002 A1 * 5/2005 Holland-Letz ..... B25B 23/12 81/451
2005/0166725 A1 * 8/2005 Chen ..... B25B 23/12 81/451
2008/0023924 A1 * 1/2008 Chiang ..... B23B 31/008 279/14
2008/0047075 A1 * 2/2008 Chang ..... B25B 23/12 7/170
2008/0100005 A1 * 5/2008 Chen ..... B25B 15/001 279/75
2008/0121075 A1 * 5/2008 Meng ..... B25B 15/001 81/177.85
2008/0184852 A1 * 8/2008 Peters ..... B25B 15/001 81/439
2008/0184853 A1 * 8/2008 Chen ..... B25B 23/12 81/451
2008/0216618 A1 * 9/2008 Chen ..... B25B 23/12 81/451
2009/0107304 A1 * 4/2009 Chiang ..... B25B 15/001 81/429
2009/0139379 A1 * 6/2009 Chiang ..... B25B 23/12 81/438
2009/0174157 A1 * 7/2009 Chang ..... B25B 15/001 279/99
2009/0256319 A1 * 10/2009 Seymour ..... B23B 31/1071 279/75
2009/0288525 A1 * 11/2009 Chen ..... B25B 23/12 81/451
2011/0023666 A1 * 2/2011 Hsu ..... B25B 23/0035 81/438
2011/0049816 A1 * 3/2011 Hsu ..... B25B 23/0035 279/30
2012/0104702 A1 * 5/2012 Hu ..... B25B 15/001 279/128
2012/0272795 A1 * 11/2012 Chen ..... B25B 13/481 81/177.75
2012/0280461 A1 * 11/2012 Hu ..... B25B 23/0035 279/46.1
2013/0220086 A1 * 8/2013 Peters ..... B23B 31/10 81/451
2014/0015205 A1 * 1/2014 Viuf ..... B25B 15/001 279/46.1
2014/0311302 A1 * 10/2014 Taguchi ..... B25B 23/0035 81/437
2015/0143966 A1 * 5/2015 Pischke ..... B43K 23/08 81/488

* cited by examiner

BIT ASSEMBLY

RELATED APPLICATION INFORMATION

This application claims the benefit of CN 201310275271.3, filed Jul. 2, 2014, and CN 201320390803.3, filed Jul. 2, 2014, the disclosures of which are incorporated herein by reference in their entirety.

FIELD OF THE DISCLOSURE

The subject disclosure generally relates to bit assemblies, and more particularly, to a bit assembly adapted to reduce impact.

BACKGROUND OF THE DISCLOSURE

Electrical tools using a bit, driven by impact, are generally known. Since such tools subject a bit to high frequency impacts during operation, there is a higher requirement for the toughness of the bit. A traditional bit is formed from a single metal, thus the hardness of the bit from front end to back end is consistent. Generally, the requirement for the toughness is sacrificed for meeting the requirements for wear resistance and durability. Once the hardness is reduced to enhance the toughness, the wear resistance and durability may be reduced greatly, and even lower than the standard requirement, thus cannot be satisfactory.

SUMMARY

In order to solve at least the above-noted problems, hereinafter is described a bit assembly which solves the conflict between the toughness and the hardness of the bit and which is relatively easy to manufacture.

More particularly, an exemplary bit assembly comprises a bit for driving a screw, a shank for holding the bit and for driving the bit to rotate about a pivot axis such that the bit is capable of moving relative to the shank in a predetermined range, and a limiting structure formed between the bit and the shank for preventing the bit from moving beyond the predetermined range.

Further, the bit may be capable of moving along a direction which is along the pivot axis.

Further, the limiting structure may comprise a first stop portion formed on the bit and a second stop portion formed on the shank wherein the first and second stop portions prevent the bit from detaching from the shank.

Further, the limiting structure may also comprise a third stop portion formed on the bit adjacent to the first stop portion and a fourth stop portion formed on the shank adjacent to the second stop portion such that, when the fourth stop portion contacts the third stop portion, the bit is prevented from further moving closer to the shank in a direction along the pivot axis.

Further, the bit may comprise a first connecting portion formed on first end of the bit and a working portion formed on a second end of the bit opposite to the first end and the shank may comprise a driven portion which is capable of being driven to rotate by a torque tool and a second connecting portion for engaging with the first connecting portion so as to connect the bit and the shank.

Further, the first connecting portion may comprise an engaging portion and a first annular groove positioned adjacent to the engaging portion with the first and third stop portions being positioned on opposite ends of the first annular groove and the second connecting portion may define a receiving chamber with one end opened in the direction along the pivot axis and a first annular protrusion may be formed on an open end of the receiving chamber with the engaging portion being received in the receiving chamber and the first annular protrusion being received in the first annular groove and with the second and fourth stop portions being opposite ends of the first annular protrusion.

Further, the engaging portion may be shorter than the receiving chamber in the direction along the pivot axis.

Further, a length of the first annular groove may be greater than that of the first annular protrusion in the direction along the pivot axis.

Further, the engaging portion may be a substantially regular hexagonal and the receiving chamber may be a substantially regular hexagonal with the engaging portion being smaller than the receiving chamber in a direction perpendicular to the pivot axis.

Further, a hardness of the bit may be greater than that of the shank.

Further, the bit assembly may comprise a function accessory mounted to the bit body.

Further, the function accessory may comprise an accessory body which is capable of receiving a portion of the bit body, a stop member mounted to a first end of the accessory body for stopping the bit body from detaching from the accessory body, and a functioning member mounted to a second end of the accessory body opposite to the first end, wherein the function accessory is in sliding connection with the bit body.

Further, the accessory body may define a first stepped hole for at least one end of the bit body passing through the pivot axis and may comprise a first restricting portion arranged on the external surface of the accessory body or in an inner wall of the first stepped hole for fixing the stop member, and a second restricting portion positioned in the first stepped hole for preventing the bit body moving apart from the function accessory.

Further, the second restricting portion may comprise an annular plate formed by the first stepped hole and substantially perpendicular to the pivot axis which is capable of preventing the first connecting portion or the second connecting portion from passing through the first stepped hole.

Further, the first restricting portion may be a second annular groove defined in the inner wall of the first stepped hole and the stop member may be a gasket mounted in the second annular groove.

Further, the first restricting portion may comprise a second annular protrusion or a section of an external thread arranged on the external surface of the accessory body and the stop member may be a sleeve which mounted to the accessory body by the second annular protrusion or the section of the external thread.

Further, the stop member may define a through-hole which is capable of allowing the working portion or the driven portion to pass there through and a first annular bench portion which is capable of preventing the first connecting portion or the second connecting portion from passing through the through-hole.

Further, the functioning member may be an annular magnet.

Further, the first stepped hole may comprise an accommodated portion adjacent to one end of the accessory body for receiving the functioning member.

Further, the function accessory may be made of a transparent material, and the bit body or the function accessory may comprise an illuminated portion formed by an illuminated material.

With the combination of the bit body and the shank as described, the working member and the driven member are made of different materials and form a sliding connection so that they have a certain buffer space in the axial direction and the circumferential direction thereby reducing the effect of the impact on the service life.

DETAILED DESCRIPTION

Figure 1:
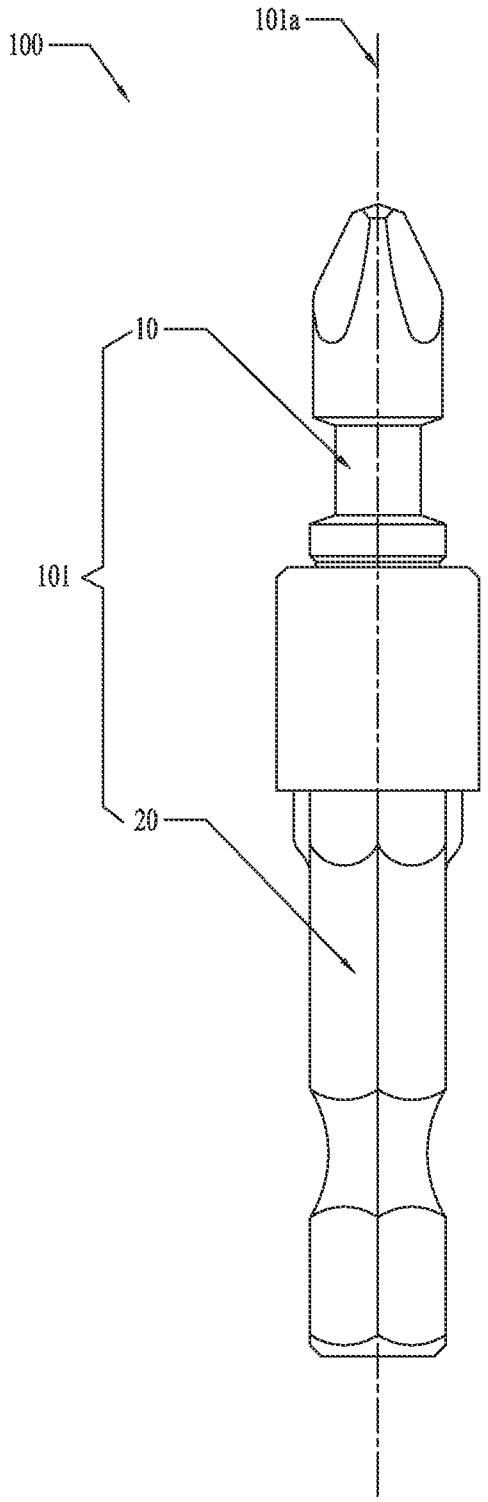
FIG. 1 is a structure schematic view of an exemplary embodiment of a bit body constructed according to the description which follows.

The following will describe an exemplary specific embodiment of a bit assembly with reference to the drawings.

FIGS. 1-5 illustrate a bit assembly 100, in exemplary form of an impact screwdriver bit, which will be subjected to a periodic impact during operation. The bit assembly 100 mainly includes a bit body 101 having a bit 10 and a shank 20.

The bit 10 is mainly used to achieve the function of striking screws by contacting the screws. The shank 20 is used to transmit a torque to the bit 10 so as to drive the bit 10 to rotate about a pivot axis 101*a*.

It is well known for the person skilled in the art that the bit 10 has a pivoting axis 101*a* and how to determine this pivoting axis 101*a*, thus it is unnecessary to go into details here.

It should be noted that in order to describe the features and relative relations of various parts of the described bit assembly the descriptions used herein will refer to a common space which is defined by a cylindrical coordinate with the pivot axis 101*a* as the central axis. The axial direction of the pivot axis 101*a* is the axial direction of the cylindrical coordinate; the radial direction of the pivot axis 101*a* is the radial direction of the cylindrical coordinate; and the circumferential direction of the pivot axis 101*a* is the circumferential direction of the cylindrical coordinate. Without any special instruction, the axial direction, radial direction and circumferential direction in this description refer to the aforesaid axial direction, radial direction and circumferential direction referenced to the pivot axis 101*a*.

As a preferred embodiment, the bit 10 has an illuminated portion formed by an illuminated material. The illuminated portion is positioned on the bit 10 so that, without sufficient light, the illuminated portion can perform an illuminating function.

The bit 10 and the shank 20 form a sliding connection with a predetermined range. A limiting structure 200 is formed between the bit 10 and the shank 20 for preventing the bit 10 from moving beyond the predetermined range.

The bit 10 is moveable at least in the direction along the pivot axis 101*a*, and the limiting structure 200 of the bit 10 and the shank 20 has an outer profile intersecting with the direction along the pivot axis 101*a*.

Figure 2:
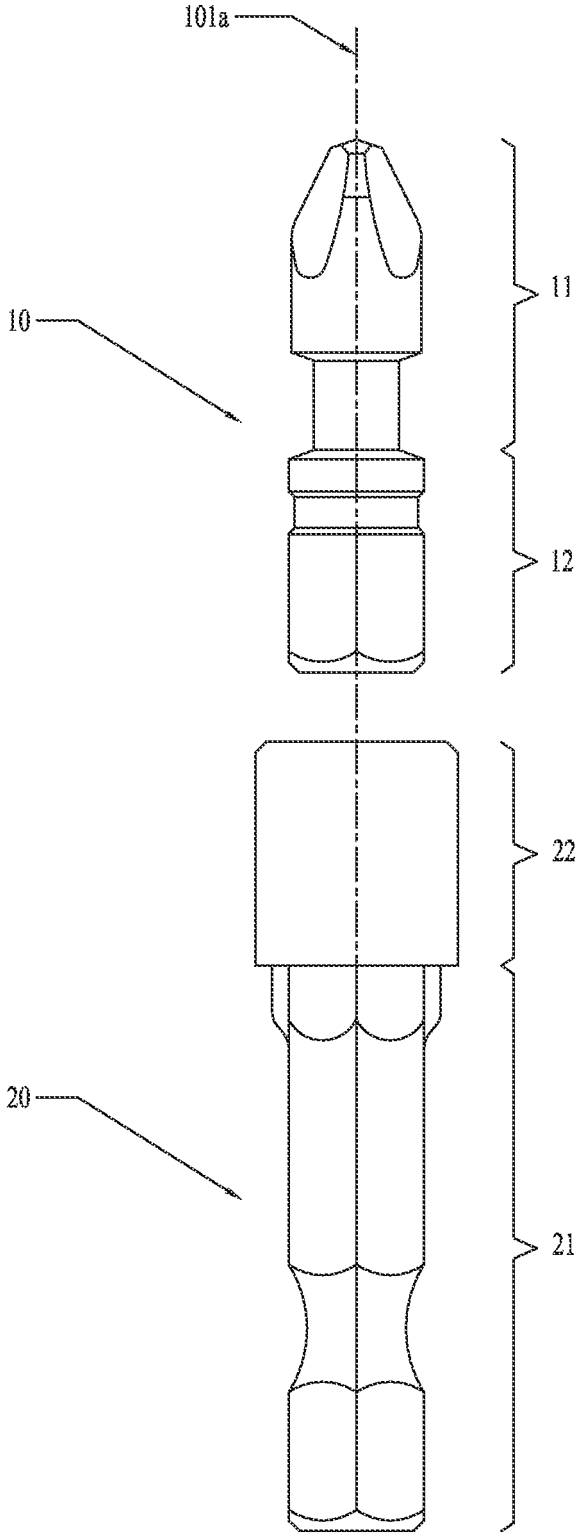
FIG. 2 is an exploded schematic view of the bit body of FIG. 1.
Figure 3:
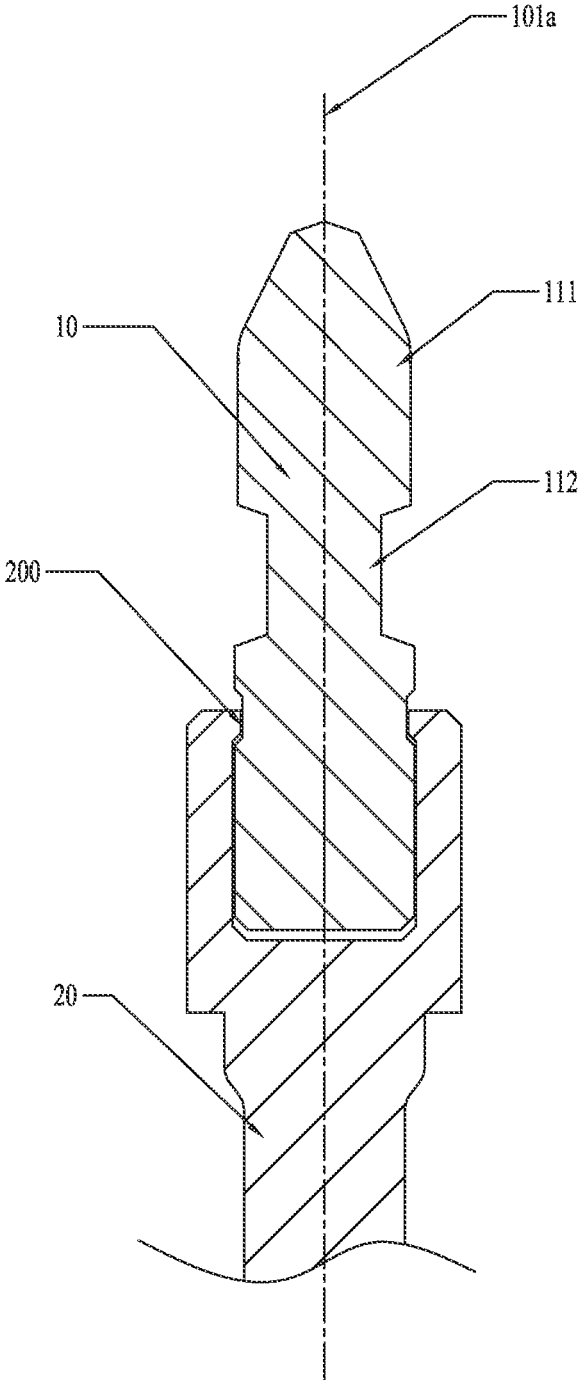
FIG. 3 is a sectional schematic view of the bit body of FIG. 1.
Figure 4:
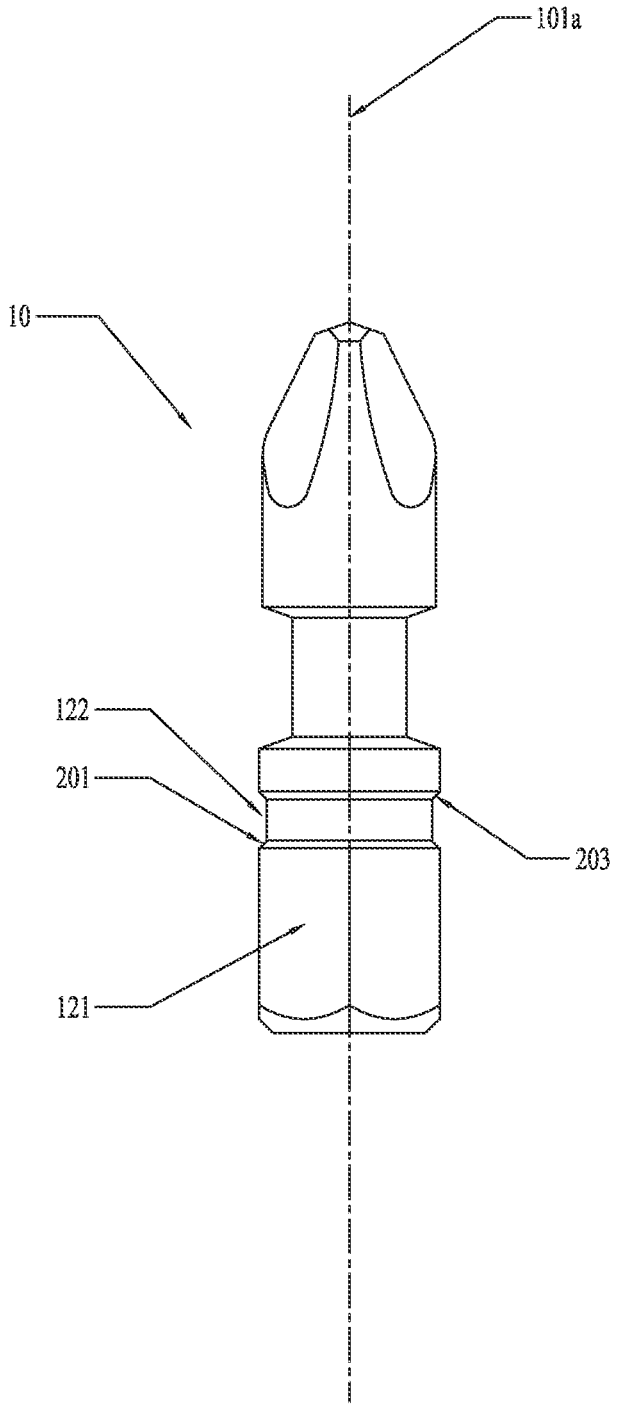
FIG. 4 is a structure schematic view of the bit of FIG. 1.

As shown in FIG. 2, the bit 10 includes a first end forming a working portion 11 and a second end opposite to the first end forming a first connecting portion 12. The shank 20 has a first end forming a second connecting portion 22 and a second end opposite to the first end forming a driven portion 21. The working portion 11 is used to strike the screws and the driven portion 21 is mainly used to mate with the torque tools. The working portion 11 includes a head portion 111 for contacting the screws and neck portion 112 for connecting the head portion 111 to the first connecting portion 12.

The limiting structure 200 includes a first stop portion 201 formed on the bit 10 and a second stop portion 202 formed on the shank 20 which prevent the bit 10 from detaching from the shank 20.

The limiting structure 200 also includes a third stop portion 203 formed on the bit 10 adjacent to the first stop portion 201 and a fourth stop portion 204 formed on the shank 20 adjacent to the second stop portion 202 so that, when the fourth stop portion 204 contacts the third stop portion 203, the bit 10 is prevented from further moving closer to the shank 20 along the direction along the pivot axis 101*a*.

The first connecting portion 12 includes an engaging portion 121 and defines a first annular groove 122 adjacent to the engaging portion 121, the first and third stop portions 201,203 are positioned on opposite ends of first annular groove 122.

The second connecting portion 22 defines a receiving chamber 221 with one end opened in the direction along the pivot axis 101*a* and includes a first annular protrusion 222 formed on the open end of the receiving chamber 222.

The engaging portion 121 is received in the receiving chamber 221 and the first annular protrusion 222 is received in the first annular groove 122 and the second and fourth stop portions 202,204 are at opposite ends of the first annular protrusion 222.

Figure 5:
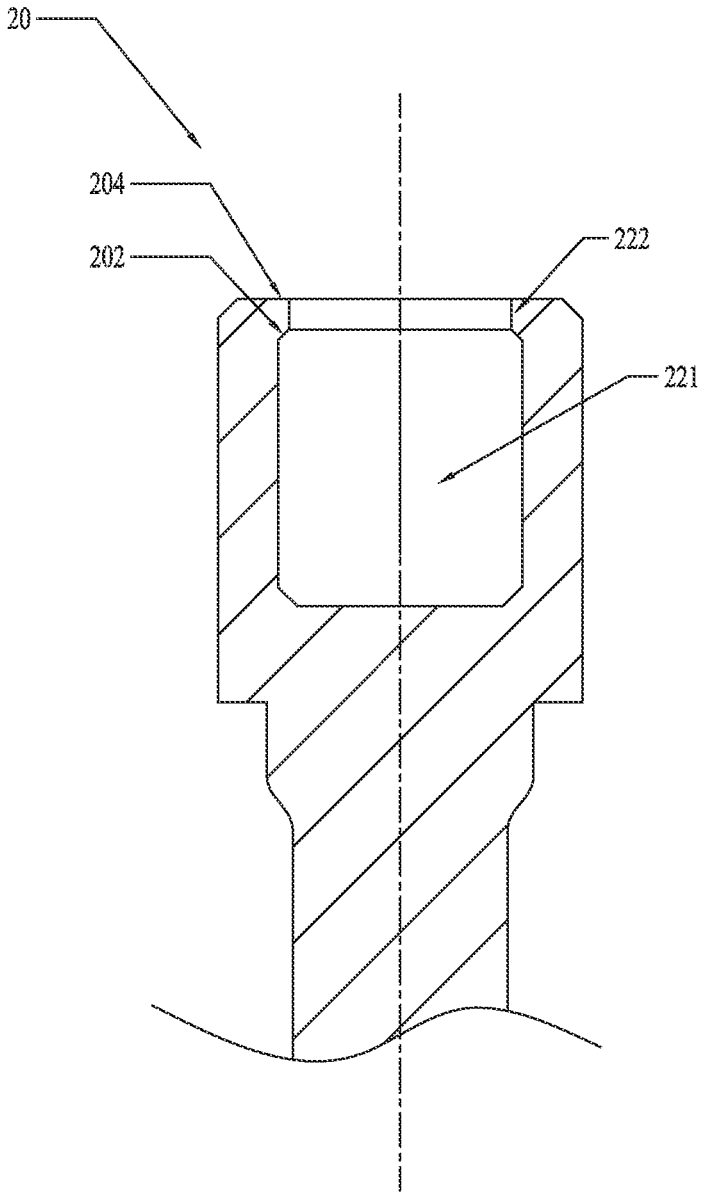
FIG. 5 is a partial sectional schematic view of the shank of FIG. 1.
Figure 6:
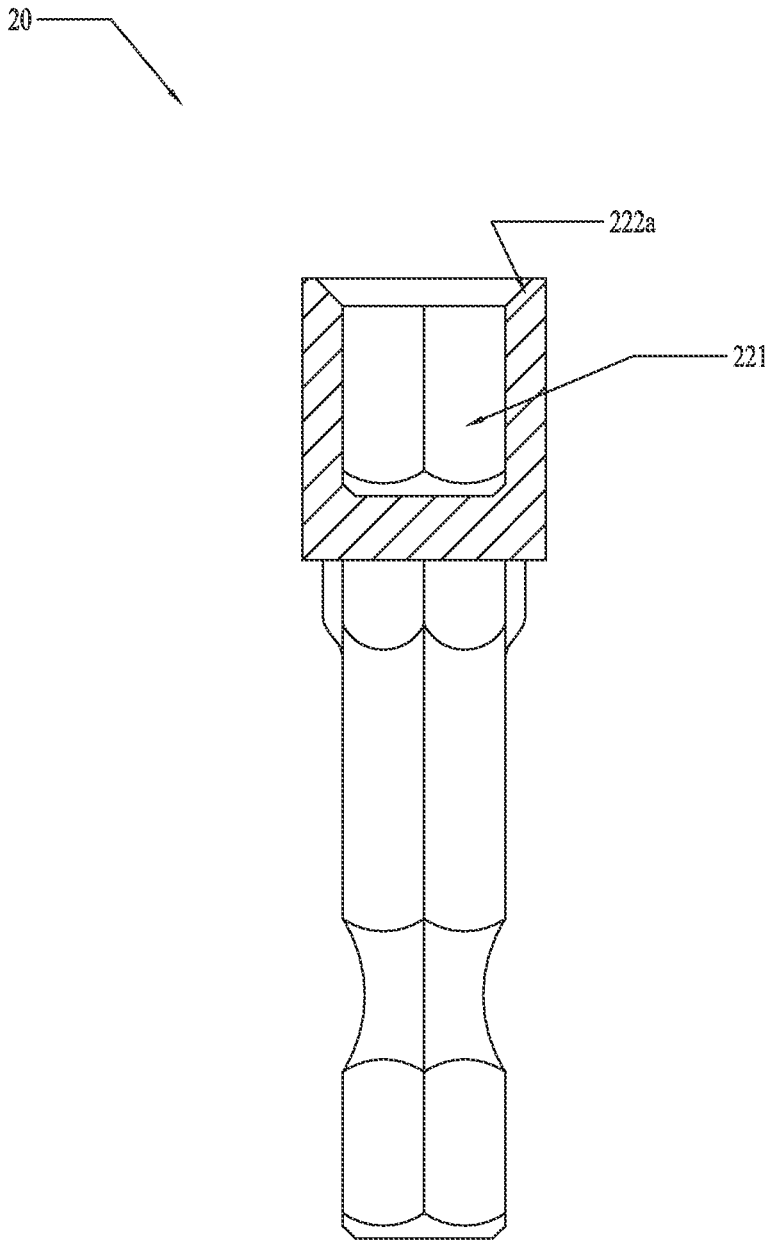
FIG. 6 is a sectional schematic view of the shank of FIG. 1 before the receiving chamber has been stamped.
Figure 7:
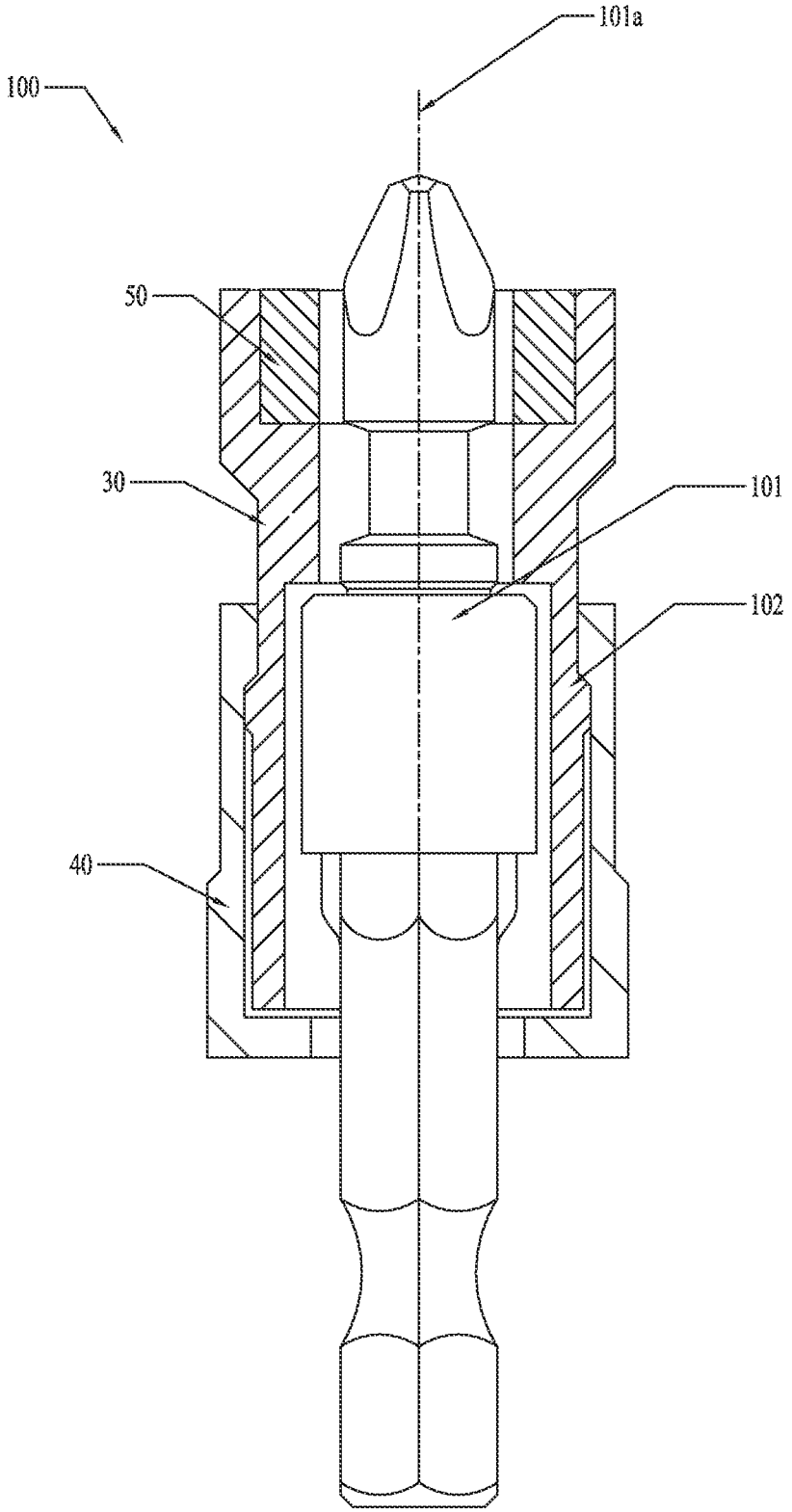
FIG. 7 is a sectional schematic view of the bit body of FIG. 1 mated with an exemplary function accessory.
Figure 8:
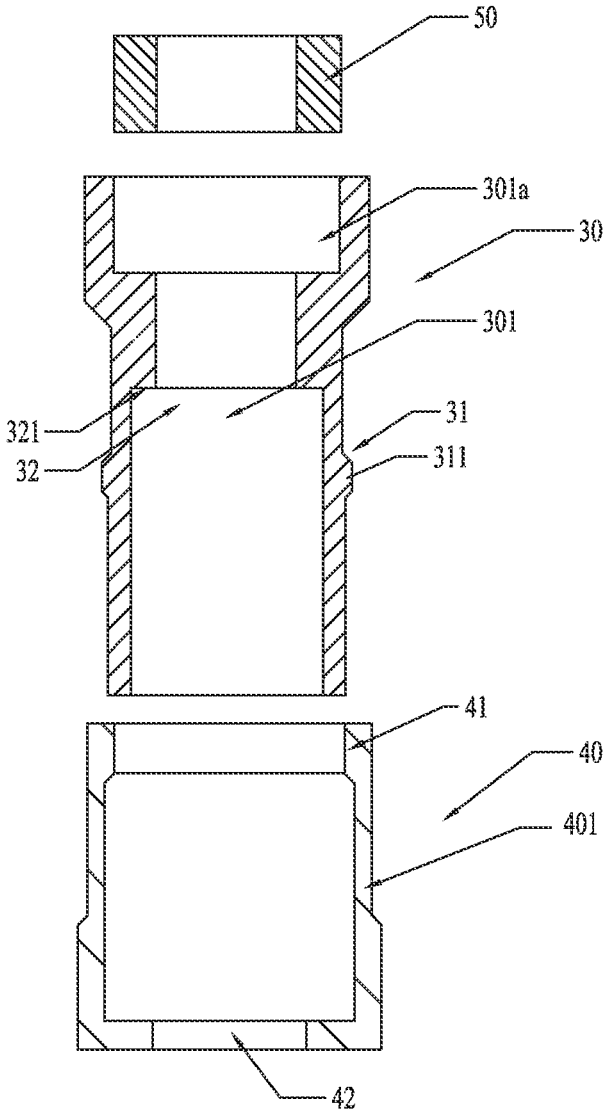
FIG. 8 is a an exploded schematic view of the function accessory of FIG. 7.

As shown in FIG. 7, before the engaging portion 121 is received into the receiving chamber 221, the first annular protrusion 222 has not been formed. After the engaging portion 121 is inserted in the receiving chamber 221, the whole may be processed by stamping, and the top end 222*a* of the receiving chamber 221 is distorted plastically and bent inwards to form the first annular protrusion 222 as shown in FIG. 5.

The engaging portion 121 is preferably shorter than the receiving chamber 221 in the direction along the pivot axis 101*a* and the length of the first annular groove 122 is preferably greater than that of the first annular protrusion 222 in the direction along the pivot axis 101, the engaging portion 121 is substantially regular hexagonal in shape and the receiving chamber 221 is substantially regular hexagonal in shape, and the engaging portion 121 is preferably smaller than the receiving chamber 221 in a direction perpendicular to the pivot axis 101*a*. The service life of the bit body 101 is increased by the axial and circumferential space between the bit 10 and the shank 20. The axial and circumferential space is capable of reducing the impact between the bit 10 and the shank 20 when they are moving relatively.

Referring to FIGS. 7-10, the bit assembly 100 may further include a function accessory 102 mounted to the bit body 101.

The function accessory 102 includes an accessory body 30 which is capable of receiving a portion of the bit body 101, a stop member 40 mounted to a first end of the accessory body 30 for stopping the bit body 101 from detaching from the accessory body 30, and a function member 50 mounted to a second end of the accessory body 30 opposite to the first end, wherein the function accessory 102 is in sliding connection with the bit body 101.

As a preferred embodiment, the accessory body 30 defines a first stepped hole 301 for at least one end of the bit body 101 passing through along the pivot axis 101*a*, and includes a first restricting portion 31 arranged on the external surface of the accessory body 30 for fixing the stop member 40, and a second restricting portion 32 positioned in the first stepped hole 301 for preventing the bit body 101 moving apart from the function accessory 102.

The function accessory 102 is preferably made of a transparent material.

The illustrated second restricting portion 32 further includes an annular plane 321 formed by the first stepped hole 301 and arranged substantially perpendicular to the pivot axis 101*a* which is capable of preventing the first connecting portion 12 or the second connecting portion 22 from passing through the first stepped hole 301.

The illustrated first restricting portion 31 includes a second annular protrusion 311 or a section of external thread arranged on the external surface of the accessory body 30, and the stop member 40 is a sleeve 401 which is mounted to the accessory body 30 by the second annular protrusion 311 or the section of external thread. The stop member 40 includes a third annular protrusion 41 or section of internal thread arranged on an inner surface of the sleeve 401.

The illustrated stop member 40 defines a through-hole 42 which allows the working portion 11 or the driven portion 21 to pass there through and an annular step portion which prevents the first connecting portion 12 or the second connecting portion 22 from passing through the through-hole 42.

The illustrated first stepped hole 301 includes an accommodated portion 301*a* adjacent to one end of the accessory body 30 for receiving the function member 50. The function member 50 is preferably an annular magnet.

Figure 9:
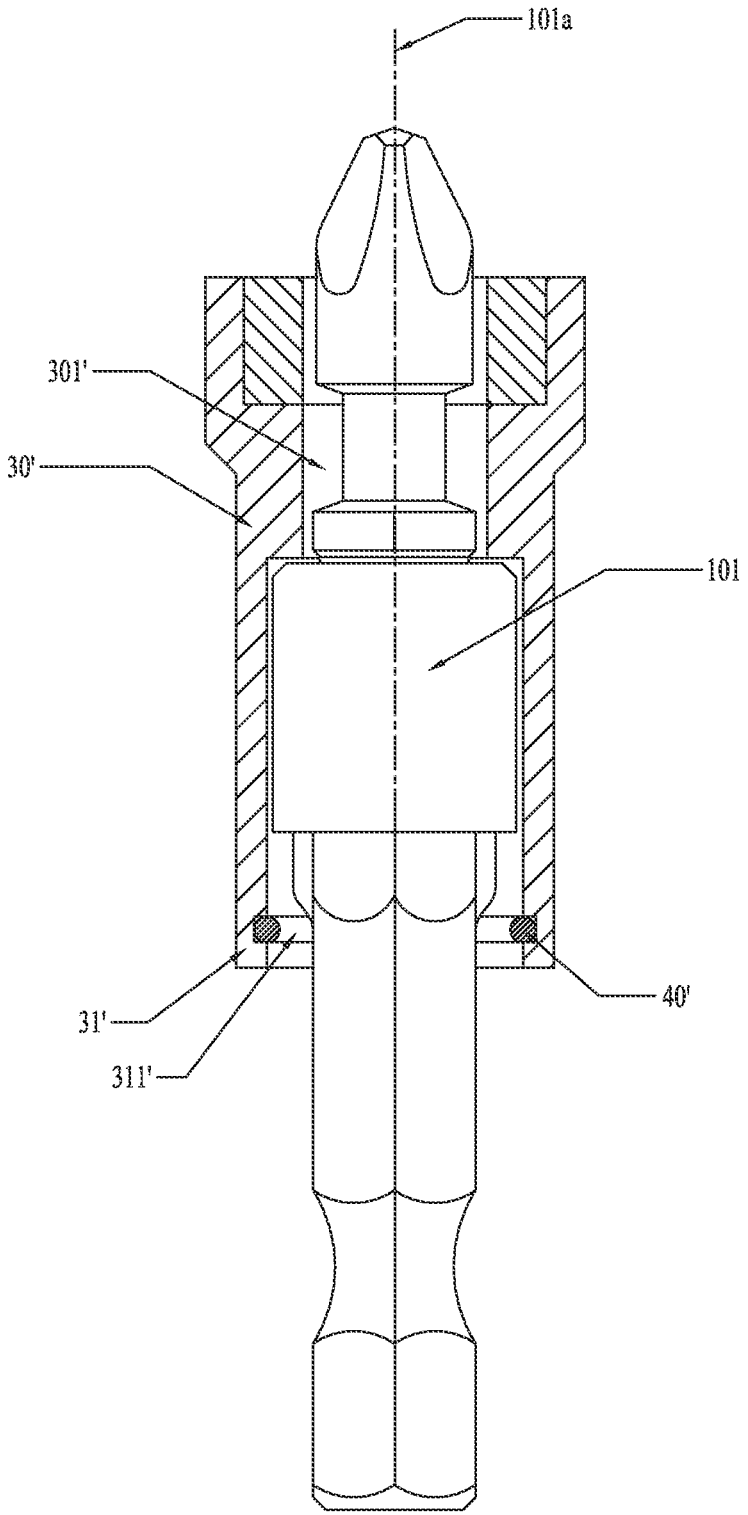
FIG. 9 is a sectional schematic view of the bit body of FIG. 1 mated with another exemplary function accessory.

As shown in FIG. 9, a further accessory body 30' defines a first stepped hole 301' for allowing at least one end of the bit body 101 to pass there through along the pivot axis 101*a* and which includes a first restricting portion 31' arranged in an inner wall of the first stepped hole 301'. The first restricting portion 31' is an annular groove 311' defined in the inner wall of the first stepped hole 301' and the stop member 40' is a gasket mounted in the annular groove 311'. The gasket is preferably made of elastic material.

The specific embodiments described above are only intended to illustrate the ideas and principles of the present invention, not to restrict the content of the present invention. Those having ordinary skill in the art can appreciate that besides the above preferred embodiments, the present invention may also include many other alternative or modified embodiments, which are still intended to fall within the scope of the following claims.

What is claimed is:

1. A bit assembly, comprising a bit body, wherein the bit body comprises:

a bit for driving a screw;

a shank for holding the bit and for driving the bit to rotate about a pivot axis wherein the bit is capable of moving relative to the shank in a predetermined range; and a limiting structure formed between the bit and the shank for preventing the bit from moving beyond the predetermined range, wherein the shank has a receiving chamber with one end opened in the direction parallel to the pivot axis, and wherein the receiving chamber comprises a first annular protrusion formed on the open end of the receiving chamber.

2. The bit assembly according to claim 1, wherein the bit is sized to move relative to the shank in a direction along the pivot axis.

3. The bit assembly according to claim 2, wherein the limiting structure comprises a first stop portion formed on the bit and a second stop portion formed on the shank wherein the first stop portion and the second stop portion cooperate to prevent the bit from detaching from the shank.

4. The bit assembly according to claim 3, wherein the limiting structure further comprises a third stop portion formed on the bit adjacent to the first stop portion and a fourth stop portion formed on the shank adjacent to the second stop portion such that, when the fourth stop portion contacts the third stop portion, the bit is prevented from moving further closer to the shank in a direction along the pivot axis.

5. The bit assembly according to claim 4, wherein the bit further comprises a first connecting portion formed on first end of the bit and a working portion formed on a second end of the bit opposite to the first end and the shank comprises a driven portion which is capable of being driven to rotate by a torque tool and a second connecting portion engaging with the first connecting portion so as to connect the bit and the shank.

6. The bit assembly according to claim 5, wherein the first connecting portion comprises an engaging portion and defines a first annular groove adjacent to the engaging portion, the first and third stop portions are positioned on opposite ends of first annular groove and the second connecting portion defines a receiving chamber with one end opened in the direction along the pivot axis and comprises the first annular protrusion formed on the open end of the receiving chamber and wherein the engaging portion is received in the receiving chamber and the first annular protrusion is received in the first annular groove such that the second and fourth stop portions are located at opposite ends of the first annular protrusion.

7. The bit assembly according to claim 6, wherein the engaging portion is shorter than the receiving chamber in the direction along the pivot axis.

8. The bit assembly according to claim 7, wherein a length of the first annular groove is greater than that of the first annular protrusion in the direction along the pivot axis.

9. The bit assembly according to claim 8, wherein the engaging portion is substantially regular hexagonal in shape and the receiving chamber is substantially regular hexagonal in shape and the engaging portion is smaller than the receiving chamber in a direction perpendicular to the pivot axis.

10. The bit assembly according to claim 1, wherein a hardness of the bit is greater than a hardness of the shank.

11. The bit assembly according to claim 1, wherein the bit assembly further comprises a function accessory mounted to the bit body.

12. The bit assembly according to claim 11, wherein the function accessory comprises:

an accessory body which is adapted to receive a portion of the bit body;

a stop member mounted to a first end of the accessory body for stopping the bit body from detaching from the accessory body; and a function member mounted to a second end of the accessory body opposite to the first end, wherein the function accessory is in sliding connection with the bit body.

13. The bit assembly according to claim 12, wherein the accessory body defines a first stepped hole to allow at least one end of the bit body to pass there through along the pivot axis and comprises a first restricting portion arranged on the external surface of the accessory body or in an inner wall of the first stepped hole for fixing the stop member and a second restricting portion positioned in the first stepped hole for preventing the bit body from moving apart from the function accessory.

14. The bit assembly according to claim 13, wherein the second restricting portion comprises an annular plate formed by the first stepped hole and positioned substantially perpendicular to the pivot axis to prevent the first connecting portion or the second connecting portion from passing through the first stepped hole.

15. The bit assembly according to claim 14, wherein the first restricting portion is a second annular groove defined in the inner wall of the first stepped hole and the stop member is a gasket mounted in the second annular groove.

16. The bit assembly according to claim 14, wherein the first restricting portion comprises a second annular protrusion or a section of external thread arranged on the external surface of the accessory body and the stop member is a sleeve which is mounted to the accessory body by the second annular protrusion or the section of external thread.

17. The bit assembly according to claim 16, wherein the stop member defines a through-hole which allows the working portion or the driven portion passing to pass there through and an annular step portion which prevents the first connecting portion or the second connecting portion from passing through the through-hole.

18. The bit assembly according to claim 13, wherein the function member comprises an annular magnet.

19. The bit assembly according to claim 13, wherein the first stepped hole comprises an accommodated portion located adjacent to one end of the accessory body for receiving the function member.

20. The bit assembly according to claim 1, wherein the function accessory is made of a transparent material and the bit body or the function accessory comprises an illuminated portion formed by an illuminated material.

* * * * *